US010415923B2

(12) United States Patent
Fields

(10) Patent No.: US 10,415,923 B2
(45) Date of Patent: Sep. 17, 2019

(54) PROJECTILE LAUNCHING SYSTEM

(71) Applicant: Richard T. Fields, Cumming, GA (US)

(72) Inventor: Richard T. Fields, Cumming, GA (US)

( * ) Notice: Subject to any disclaimer, the term of this patent is extended or adjusted under 35 U.S.C. 154(b) by 0 days.

(21) Appl. No.: 15/925,296

(22) Filed: Mar. 19, 2018

(65) Prior Publication Data

US 2018/0209758 A1 Jul. 26, 2018

Related U.S. Application Data

(63) Continuation of application No. 15/050,295, filed on Feb. 22, 2016, now Pat. No. 9,921,025, which is a continuation of application No. 13/908,674, filed on Jun. 3, 2013, now Pat. No. 9,267,755, which is a continuation of application No. 12/761,942, filed on Apr. 16, 2010, now Pat. No. 8,453,630.

(60) Provisional application No. 61/169,983, filed on Apr. 16, 2009.

(51) Int. Cl.

| | |
|---|---|
| ***F41B 3/02*** | (2006.01) |
| ***F42B 6/04*** | (2006.01) |
| ***F41B 7/00*** | (2006.01) |
| ***F42B 6/02*** | (2006.01) |
| ***F41B 5/00*** | (2006.01) |

(52) U.S. Cl.

CPC ..... *F41B 3/02* (2013.01); *F41B 5/0094* (2013.01); *F41B 7/00* (2013.01); *F42B 6/02* (2013.01); *F42B 6/04* (2013.01)

(58) Field of Classification Search

CPC .. F41B 3/02; F41B 5/0094; F42B 6/00; F42B 6/02; F42B 6/04

USPC ..... 473/569, 578; 124/17, 20.1, 20.3

See application file for complete search history.

(56) References Cited

U.S. PATENT DOCUMENTS

| | | | | |
|---|---|---|---|---|
| 2,667,352 | A * | 1/1954 | Sepersky | A63H 27/00 124/41.1 |
| 2,970,839 | A * | 2/1961 | Halverson | F41B 3/02 43/6 |
| 3,306,278 | A * | 2/1967 | Spatari | F41B 3/02 124/20.2 |
| 3,630,186 | A * | 12/1971 | Babyn | F41B 5/0073 124/23.1 |
| 3,834,368 | A * | 9/1974 | Geiger | F41B 3/00 124/20.3 |
| 3,918,427 | A * | 11/1975 | Tumer | F41B 3/02 124/16 |

(Continued)

OTHER PUBLICATIONS

Ricci, "Notice of Allowance issued in U.S. Appl. No. 12/761,942, filed Apr. 16, 2010, dated Feb. 1, 2013", Feb. 1, 2013, 1-5.

(Continued)

*Primary Examiner* — Alexander R Niconovich

(74) *Attorney, Agent, or Firm* — Johnson, Marcou & Isaacs, LLC

(57) ABSTRACT

A device for launching a projectile along an intended flight trajectory includes a launching mechanism. The launching mechanism includes first and second pairs of supports supporting a launching cord. A projectile having a longitudinal axis is disposed in the launching cord in a launch position prior to launch such that the projectile's longitudinal axis is perpendicular to a plane in which the launching cord is disposed. As the projectile is launched by the launching mechanism, the projectile rotates such that the projectile's longitudinal axis is parallel to the plane in which the launching cord was disposed.

20 Claims, 4 Drawing Sheets

(56) References Cited

U.S. PATENT DOCUMENTS 4,050,438 A * 9/1977 Pfotenhauer ..... F41B 3/02 124/20.1
4,247,027 A * 1/1981 Tardiff ..... F41B 5/066 124/25.7
4,337,940 A 7/1982 Soong et al.
4,411,248 A * 10/1983 Kivenson ..... F41B 3/02 124/20.1
4,419,978 A 12/1983 Loftus et al.
4,458,658 A * 7/1984 Blair ..... F41B 3/02 124/20.1
4,703,744 A * 11/1987 Taylor ..... F41B 3/02 124/20.1
4,706,958 A * 11/1987 Inoue ..... A63B 37/0003 40/327
4,858,588 A * 8/1989 Bozek ..... F41B 5/0094 124/23.1
4,958,617 A * 9/1990 Anderson ..... F41B 5/143 124/24.1
4,995,372 A 2/1991 Topel
5,018,747 A * 5/1991 Brown ..... F41B 3/02 124/20.3
5,123,643 A * 6/1992 Heilhecker ..... A63B 69/407 124/21
5,173,069 A * 12/1992 Litos ..... A63H 33/185 446/36
5,282,453 A * 2/1994 Chia ..... F42B 6/00 124/20.1
5,345,922 A * 9/1994 Ott ..... F41B 3/02 124/16
5,501,207 A 3/1996 Black et al.
5,657,984 A 8/1997 Leo
5,803,067 A * 9/1998 Ellenburg ..... F41B 3/02 124/20.1
5,902,199 A * 5/1999 Adams, Jr. ..... F42B 6/04 473/578
6,027,421 A * 2/2000 Adams, Jr. ..... F42B 6/08 473/578
6,050,252 A 4/2000 Etheridge
6,742,509 B2 * 6/2004 Hunter ..... F41B 3/02 124/17
7,392,801 B2 * 7/2008 McCallister ..... A63B 21/0552 124/17
7,748,369 B2 * 7/2010 Chee ..... F41B 3/02 124/20.1
8,453,630 B2 6/2013 Fields et al.
8,567,376 B2 * 10/2013 Flint ..... F41B 5/12 124/20.3
8,939,136 B2 * 1/2015 Gaus ..... F41F 7/00 124/4
9,234,718 B2 * 1/2016 Ricke ..... F41B 3/02
9,267,755 B2 2/2016 Fields
9,310,171 B2 * 4/2016 Cummings ..... F42B 6/02
9,395,139 B2 * 7/2016 Pena ..... F41B 3/02
9,513,079 B1 * 12/2016 Missel ..... F41B 5/105
9,915,493 B2 * 3/2018 Becker ..... F41B 5/0094
9,921,025 B2 3/2018 Fields
9,927,203 B1 * 3/2018 Shapiro ..... F41B 3/02
2009/0032002 A1 * 2/2009 Howard ..... F41B 5/0094 124/25.6
2014/0338647 A1 * 11/2014 Cummings ..... F41B 7/08 124/20.3
2015/0260478 A1 * 9/2015 Park ..... F41B 5/12 124/20.3

OTHER PUBLICATIONS

Ricci, "Notice of Allowance issued in U.S. Appl. No. 13/908,674, filed Jun. 3, 2013, dated Oct. 15, 2015", Oct. 15, 2015, 1-5.
Ricci, "Notice of Allowance issued in U.S. Appl. No. 15/050,295, filed Feb. 22, 2016, dated Nov. 6, 2017", 1-5 pages.
Ricci, "Office Action issued in U.S. Appl. No. 12/761,942, filed Apr. 16, 2010, dated Aug. 15, 2012", Aug. 15, 2012, 1-5.
Ricci, "Office Action issued in U.S. Appl. No. 13/908,674, filed Jun. 3, 2013, dated Dec. 17, 2014", Dec. 17, 2014, 1-6.
Ricci, "Office Action issued in U.S. Appl. No. 13/908,674, filed Jun. 3, 2013, dated Jul. 2, 2015", Jul. 2, 2015, 1-5.
Ricci, "Office Action issued in U.S. Appl. No. 15/050,295, filed Feb. 22, 2016", dated Nov. 29, 2016, 1-6 pages.

* cited by examiner

PROJECTILE LAUNCHING SYSTEM

RELATED APPLICATIONS

This patent application is a continuation of and claims priority to U.S. patent application Ser. No. 15/050,295 filed Feb. 22, 2016 and entitled "Arrow for Projectile Launching System" (U.S. Pat. No. 9,921,025), which claims priority to U.S. patent application Ser. No. 13/908,674 filed Jun. 3, 2013 and entitled "Projectile Launching System" (U.S. Pat. No. 9,267,755), which claims priority to U.S. patent application Ser. No. 12/761,942 filed Apr. 16, 2010 and entitled "Projectile Launching System" (U.S. Pat. No. 8,453,630 issued Jun. 4, 2013), which claims priority to U.S. Provisional Patent Application No. 61/169,983 filed Apr. 16, 2009 and entitled "Vertical Release Archery System." The entire contents of the above-identified priority applications are hereby fully incorporated herein by reference.

TECHNICAL FIELD

The present invention relates to a projectile launching system. More particularly, the present invention relates to an archery system that launches arrows from an initial position that is perpendicular to a direction in which the arrow travels after launch.

BACKGROUND

Several types of archery bows and crossbows (hereinafter sometimes referred to collectively as "bows") have been used over the years. Conventional bows launch arrows pointing in the directional travel. Consequently, conventional archery arrows have standard lengths of, for example, 28-33 inches to match various draw lengths for different people. The long arrow lengths allow stabilizing the front of the arrow when the rear of the arrow is pulled back with the string of the bow. The draw length of a bow is limited by the length of the arrow. The draw length cannot be longer than the arrow. Otherwise, the tip of the arrow is drawn behind the front portion of the bow, which creates a dangerous position if the tip of the arrow hits the front of the bow upon launch. Additionally, arrows of such length flex and bend in flight, thereby making them unstable and inconsistent in accuracy. Cross bows have similar issues, using arrows (sometimes called "bolts") of, for example, 16-22 inches in length.

Because conventional arrows are long, such arrows are carried in a separate pouch. Additional equipment pouches are cumbersome. Arrows for archery bows typically are carried on the shooter's back or are set near the shooter. Because the arrows are not very close to the actual bow, a shooter cannot reload and shoot multiple rounds quickly. Alternatively, extra arrows can be attached to the bow, but the shooter must retrieve an arrow, insert it on the bow, and then draw the arrow back. Such a lengthy process also is time consuming.

The arms of the convention bows have to be long enough to provide sufficient recoil to propel the arrow when launched. Consequently, conventional archery bows are very tall, and conventional cross bows are very wide. Thus, conventional bows are bulky, and may be hard to carry or maneuver in tight areas.

Conventional bows also have high pull weights, which can make it difficult to draw the arrow and make an accurate shot. Complex "compound" bows can reduce the pull weight, but complexity and cost of the device is increased.

Cross bows in particular can be hard to draw and may employ a foot stirrup for the shooter to hold the device in place while the shooter cocks the device.

Accordingly, a need exists in the art for an archery system that can launch shorter arrows, provide a lower pull weight while maintaining suitable arrow velocity, have a compact size compared to conventional systems, have a draw length that is not limited by the length of the arrow, and/or reduce draw weight without complex mechanisms.

SUMMARY

The invention relates to an archery system that launches an arrow from a position that is perpendicular to a direction of flight for the arrow. After release, the arrow rotates to a position that is parallel to the direction of flight to the target.

DETAILED DESCRIPTION OF EXEMPLARY EMBODIMENTS

Figure 1:
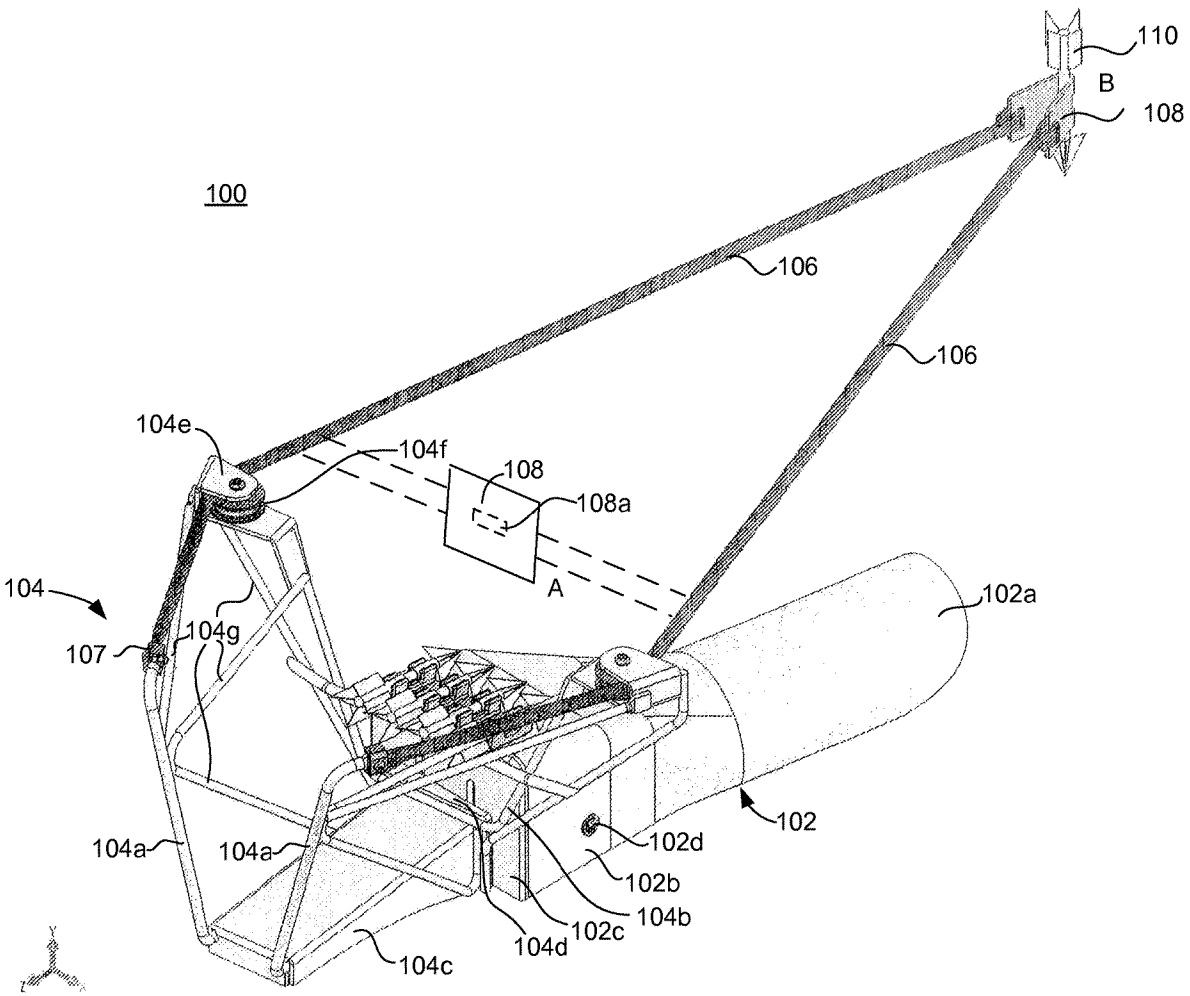
FIG. 1 is a perspective view of a projectile launching system according to an exemplary embodiment.

Referring to the drawings, in which like numerals represent like elements, aspects of the exemplary embodiments will be described.

The invention relates to an archery system that launches an arrow from a position that is perpendicular to a direction of flight for the arrow. After release, the arrow rotates to a position that is parallel to the direction of flight to the target.

FIG. 1 is a perspective view of a projectile launching system 100 according to an exemplary embodiment. The system 100 comprises an arm support 102 coupled to a launching mechanism 104. The launching mechanism comprises a pair of launching cords 106 attached thereto and a pad 108 coupled to the pair of cords 106. The pad 108 is used to hold an arrow 110 for launching via the system 100.

The arm support 102 includes a forearm portion 102*a* and a first portion 102*b*. An end plate 102*c* is affixed to one end of the arm support 102. The opposite end of the arm support 102 is open.

Figure 2B:
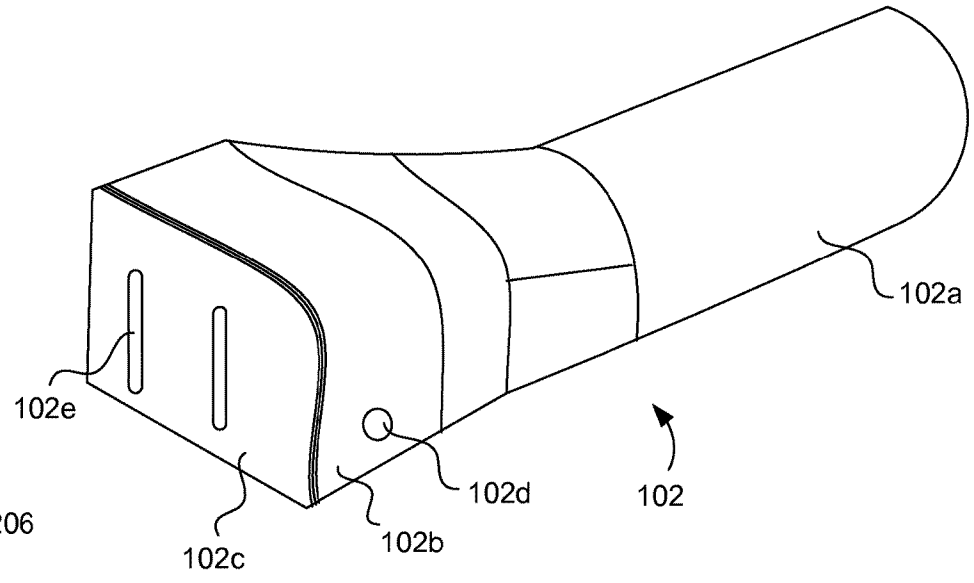
FIGS. 2*a* and 2*b* are bottom and perspective views, respectively, of the arm support depicted in FIG. 1, according to an exemplary embodiment.
Figure 2A:
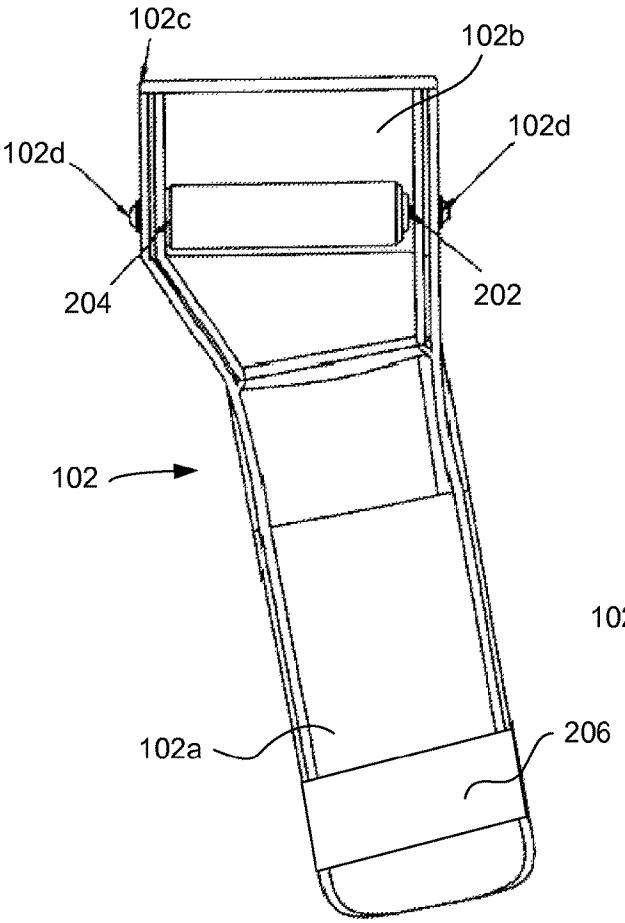

FIGS. 2*a* and 2*b* are bottom and perspective views of the arm support 102 depicted in FIG. 1, according to an exemplary embodiment. With reference to FIG. 2*a*, a handle 202 is positioned in the first portion 102. As illustrated, machine screws 102*d* are inserted through the first portion 102*b* and into the handle 202 disposed in the first portion 102*b* of the arm support 102. A foam cover 204 fits over the handle to provide a comfortable grip for the shooter. Alternative gripping mechanisms are within the scope of the invention. For example, the handle 202 can be mounted perpendicular to the position illustrated in FIG. 2*a*. Alternatively, the system 100 can be designed without a handle 202 in the arm support 102*b*. In such an exemplary embodiment, the arm support 102*b* could be secured to the shooter's arm and hand, for example, with hook and loop type straps.

In operation, the shooter grabs the handle 202 in the first portion 102*b* of the arm support 102, and the first portion 102*b* and forearm portion 102*a* of the arm support 102 fit over a shooter's first and forearm, respectively. A strap on the forearm portion 102*a* secures the arm support 102 to the shooter's forearm. The strap can be buckled or held in place via other means, such as with a hook and loop type closure. The arm support 102 can provide stability for the system 100 by securing the system 100 to the shooter's arm and hand. The arm support 102 also protects the shooter's arm from potential contact with the arrow 110.

In an exemplary embodiment, the arm support 102 can comprise multiple parts that are coupled together. For example, the forearm portion 102*a*, first portion 102*b*, and end plate 102*c* can all be separate parts that are coupled together. Additionally, each of the individual parts can comprise multiple components to create the desired shape of the arm support 102. Depending on the material used to form the parts of the arm support 102, the parts can be coupled together via screws, bolts, welding, or any other suitable means. In an alternative exemplary embodiment, the arm support 102 can be molded or formed in a single piece of material.

The launching mechanism 104 further comprises two front risers 104*a* and two rear risers 104*b*. Each of the risers 104*a*, 104*b* is coupled at one end to a base member 104*c*. As illustrated, the front risers 104*a* and the rear risers 104*b* extend at an angle away from the base member 104*c* such that the ends of the risers 104*a*, 104*b* positioned adjacent to the base member 104*c* are closer together than the opposite ends of the risers 104*a*, 104*b*. Additionally, a distance between the upper ends of the rear risers 104*b* is greater than a distance between the upper ends of the front risers 104*a*.

The risers 104*a*, 104*b* can be coupled to the base member 104*c* via any suitable means, for example, via welding, bolts, machine screws, or other suitable means.

Pulley brackets 104*e* are attached to the end of each of the rear risers 104*b* that is opposite the end of the rear risers 104*b* that is coupled to the base member 104*c*. A pulley 104*f* is positioned in each pulley bracket 104*e* such that the pulley 104*f* rotates freely within the pulley bracket 104*e*.

As illustrated, support members 140*g* can be added to provide additional strength and stability for the front risers 104*a* and the rear risers 104*b*. Any suitable number and position of the support members 140*g* can be chosen based on various design parameters, such as the strength of the materials, the draw weight of the device, and additional loads to which the launching mechanism 104 may be subjected.

The base member 104*c* includes a rear plate 104*d* coupled thereto. In an exemplary embodiment, the rear plate 104*d* can comprise a tapered profile such that one side of the rear plate 104*d* is thicker than the other side of the rear plate 104*d*. The tapered profile can offset a longitudinal axis of the launching mechanism 104 from a longitudinal axis of the arm support 102 when the launching mechanism 104 is attached to the arm support 102. The tapered profile can accommodate for an angle of the shooter's pulling motion. In an exemplary embodiment, the offset of the tapered profile can be about ten degrees. However, the offset can be increased or decreased to accommodate a specific shooter's needs or tendencies. For example, shims (not shown) can be used between the rear plate 104*d* and the end plate 102*c* to change the offset of the launching mechanism 104 from the arm support 102. For example, the invention can include multiple shims providing different offsets, and the shooter can choose one or more of the shims to provide the desired offset. Additionally, the shims can be inserted in an opposite direction to accommodate left or right handed shooters. The rear plate 104*d* can be a separate component coupled to the base member 104*c*, or the rear plate 104*d* can be formed integrally with the base member 104*c*.

The launching mechanism 104 is attached to the end plate 102*c* of the arm support 102. As illustrated, the end plate 102*c* of the arm support 102 includes slots 102*e*. Bolts (not shown) inserted through the slots 102*e* in the end plate 102*c* of the arm support 102 and through corresponding holes (not shown) in the rear plate 104*d* of the base member 104*c*, and the bolts can be secured with nuts to attach the launching mechanism 104 to the arm support 102.

In an alternative exemplary embodiment, the arm support 102 and the base member 104*c* (including the rear plate 104*d*) can be molded or formed in a single piece of material.

Each cord 106 is attached at one end to a corresponding one of the front risers 104*a*. The other end of the cord 106 is attached to the pad 108. As illustrated, a clamp 107 secures the cord 106 to the front riser 104*a*. However, any suitable method can be used to secure the cord 106 to the front riser 104*a*. Additionally, any suitable method can be used to secure the cords 106 to the pad 108. Each cord 106 extends from the front riser 104*a*, around the pulley 104*f*, and terminates at the pad 108.

In an alternative exemplary embodiment, the pulley brackets 104*e* and pulleys 104*f* can be omitted. In this case, each cord 106 would extend from the front riser 104*a*, around the end of the rear riser 104*b*, and would terminate at the pad 108. The rear risers 104*b* can comprise a bended portion on the end where the cords 106 pass to prevent the cords 106 from slipping past the rear risers 104*b*.

In other alternative exemplary embodiments, the pad 108 can be omitted. In this case, a single cord 106 can extend from one front riser 104*a*, around one pulley 104*f*, around the other pulley 104*f*, and to the other front riser 104*a*.

The pad can comprise a leather or other suitable material.

In an exemplary embodiment, the cords 106 can comprise an elastic material. The resting position of the cords 106 is depicted as position A in FIG. 1, showing the location of the cords 106 and the pad 108 in the resting position A via dashed lines. In the resting position A, a minimal amount of tension is placed on the cords 106. The shooting position of the cords 106 is depicted as position B in FIG. 1. Holding the arrow 110 in the pad 108, the shooter draws the pad 108 from position A to position B, thereby stretching the cords 106 and increasing the tension on the cords 106. When the shooter releases the arrow 110, the elasticity of the cords 106 pulls the cords 106 and the pad 108 from the shooting position B towards the resting position A, thereby propelling the arrow 110 from the launching mechanism 104.

Figure 3:
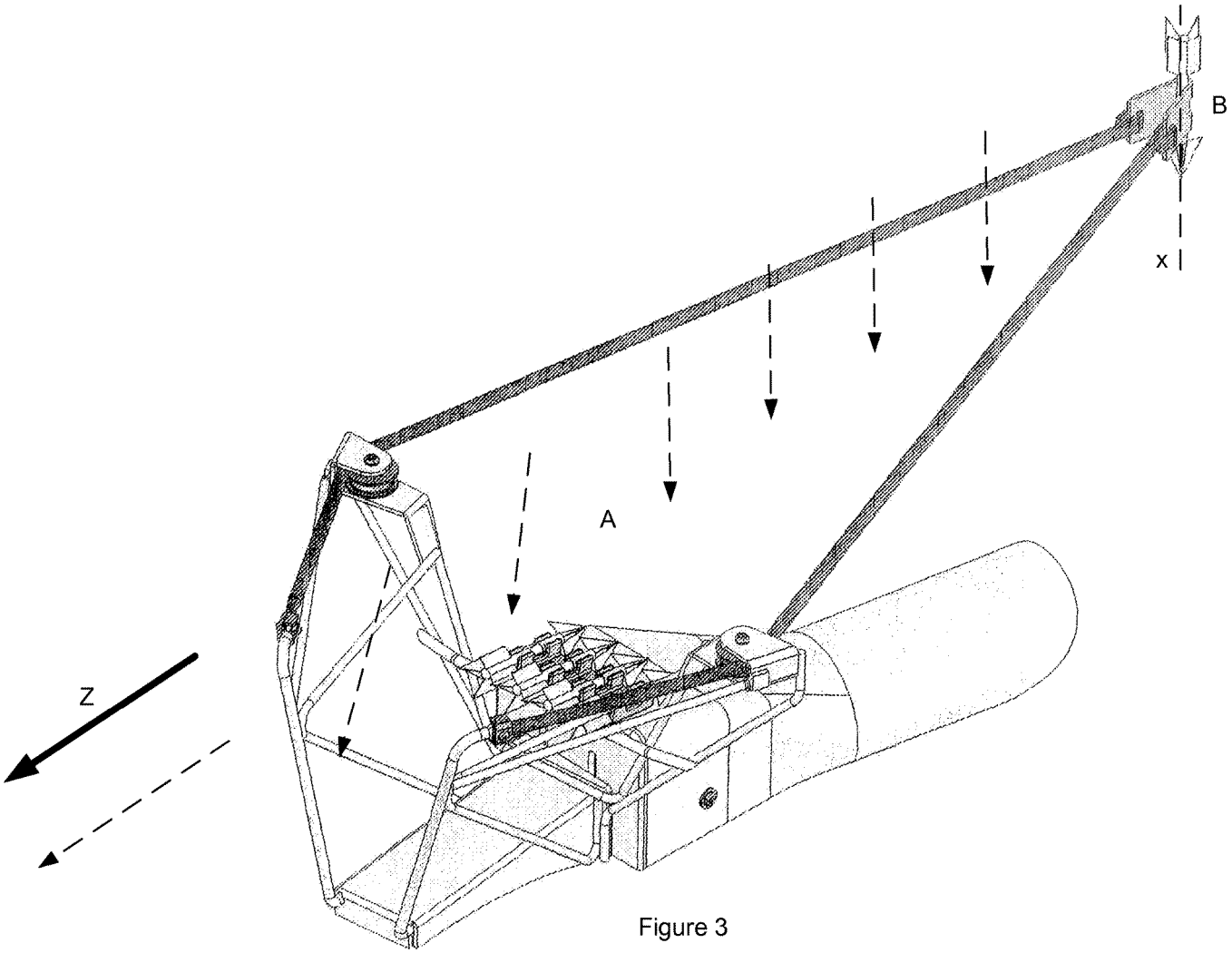
FIG. 3 is a perspective view illustrating the positioning of the arrow when launched from the projectile launching system according to an exemplary embodiment.

FIG. 3 is a perspective view illustrating the positioning of the arrow 110 when launched from the projectile launching system 100 according to an exemplary embodiment. As shown in FIG. 3, the direction in which the arrow 110 travels after launch is depicted as a flight path Z. Prior to shooting the arrow 110, when the pad 108 and arrow 110 are drawn to position B, a longitudinal axis x of the arrow 110 is disposed perpendicularly to the direction of the flight path Z. As the arrow 110 is propelled forward from position B and is released from the pad 108, the arrow 110 rotates until its longitudinal axis x is parallel to the flight path Z.

The cords 106 can comprise any suitable elastic material that provides sufficient propelling force for the arrow 110 using a draw weight appropriate for the shooter. In an exemplary embodiment, the launching cords 106 are rubber tubing. Other suitable materials can be used for the cords 106. For example, an elastic "shock" cord 106 can be used, and other materials having suitable elastic properties can be used. In certain alternative exemplary embodiments, each cord 106 can comprise multiple members, which can be twisted or braided together. One example of braiding comprises weaving two cords together by alternately inserting one cord through a hole in the other cord. For instance, each cord can have holes spaced 1 inch apart, with the holes being offset ½ inch on each cord. Then, the first cord is inserted through the first hole in the second cord, the second cord is inserted through the first hole in the first cord, the first cord is inserted through the second hole in the second cord, the second cord is inserted through the second hole in the first cord, and this process is repeated for a portion or all of the length of the cords.

Alternatively, the system 100 can be designed with a horizontal compounding feature to use a string as the launching cords 106. In this regard, the system 100 can use a conventional archery bow or cross bow type of launching mechanism 104 mounted horizontally (crosswise to the lengthwise axis of the arm support and the launching mechanism) on one or both of the front risers 104*a* and/or on one or both of the rear risers 104*b*, with its height being sufficiently spaced from the base member 104*c* and the arm support 102 to allow the "vertically" launched arrow 110 to clear the arm support 102 and the base member 104*c*.

While the exemplary embodiment is illustrated with two front risers 104*a* to which the cords 106 are attached and two rear risers 104*b* around which the cords 106 are supported, alternative embodiments can include only the two front risers 104*a*, or the alternative embodiments can include additional intermediate or rear risers 104*b* around which the cords 106 are supported. Additional intermediate or rear risers 104*b* can further compound the force of the cords 106.

The exemplary embodiment illustrates a distance between the rear risers 104*b* being greater than a distance between the front risers 104*a*. This arrangement can prevent the cords 106 from collapsing together during launch prior to release of the arrow 110 from the system 100. This arrangement also can compound the force of the cords 106, thereby increasing force exerted on the arrow 110 and the corresponding thrust, velocity, and/or impact of the arrow 110. However, alternative exemplary embodiments can include a different spacing arrangement. For example, the distance between the rear risers 104*b* can be the same as the distance between the front risers 104*a*.

Figure 4:
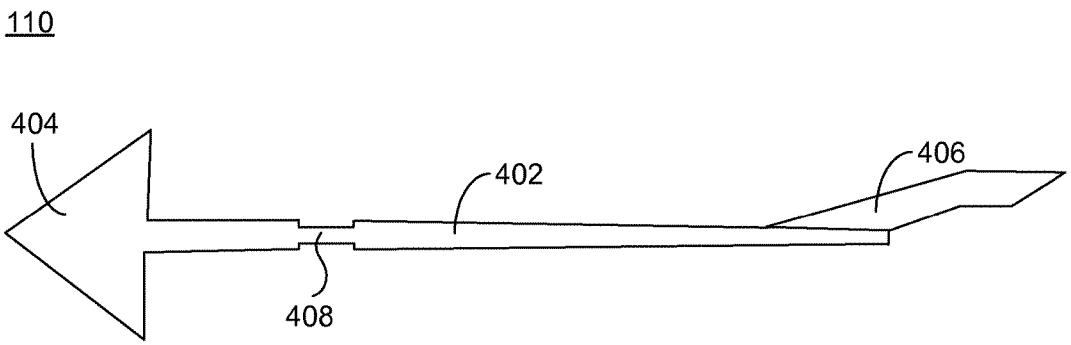
FIG. 4 is a side view of an arrow for a projectile launching system according to an exemplary embodiment.

FIG. 4 is a side view of an arrow 110 for use in the system 100 depicted in FIG. 1 according to an exemplary embodiment. The exemplary arrow 110 comprises a shaft 402, a tip 404 disposed on one end of the shaft 402, a flight (or vane) 406 disposed at or near the other end of the shaft 402, and a center of gravity marking 408. The flight 406 can comprise one or multiple components. As illustrated in FIG. 4, the center of gravity marking 408 comprises a groove in the shaft 402, and the groove is located at the center of gravity for the arrow 110. The shooter grabs the arrow 110 at the center of gravity marking 408 to place the center of gravity marking 408 (and, therefore, the center of gravity of the arrow 110) in the pad 108 for shooting. In alternative exemplary embodiments, the center of gravity marking 408 on the arrow 110 may not be a groove, and the center of gravity marking 408 on the arrow 110 may be marked in a different manner. For example, the center of gravity of the arrow 110 may be marked with a different color, with a bump(s) or other raised area on the shaft 402 either at the center of gravity or on one or both sides of the center of gravity, or by an o-ring or washer disposed on one or both sides of the center of gravity. Regardless of how the center of gravity of the arrow 110 is marked (or even if the center of gravity of the arrow 110 is not marked), the shooter can grab the arrow 110 to locate the center of gravity of the arrow 110 in the pad 108.

Exemplary lengths for the arrow 110 range from about two inches to about twelve inches, including the tip and the flight, although the invention can be scaled to operate with arrow lengths outside of that range. In certain exemplary embodiments, the arrow 110 has a length of about three inches to about six inches.

Arrows of the exemplary embodiments can have a weight of between about 300 grain to about 450 grain. Additional weights are within the scope of the invention. For example, the arrows can have a weight of between about 100 grain to about 500 grain. Additionally, the invention can be scaled to operate with arrows having a weight outside of these ranges.

Compared to the longer conventional arrows used with a conventional archery system, the system 100 described in this application may provide more accurate shooting with higher knockdown force, impact force, and/or kinetic energy. The shorter arrows also are affected less by wind when compared to longer conventional arrows. Accordingly, the shorter arrows used with the inventive system 100 may be more accurate with less "drop" over distance and using a lower pulling force. Additionally, accurate shots over a longer distance can be possible with the inventive system 100.

In an exemplary embodiment, a conventional archery release can be used to grab the arrow 110. More specifically, the release can be inserted through a slot 108*a* (FIG. 1) in the pad 108, an arrow 110 can be grabbed with the release, and the release can be back pulled through the slot 108*a* in the pad 108 to force the arrow 110 into the pad 108. Other methods of grabbing an arrow 110 with the launch pad 108 are suitable. For example, the shooter can pinch the arrow 110 with the launch pad 108 to grab the arrow 110 for launch.

The system 100 can be sighted on a target by lining up various components, such as the arrow 110, launching mechanism 104, cords 106, and target. Additionally, an archery sight (not illustrated) can be added to the system 100, if desired, by installing the archery sight on one of the front risers 104*a*, the rear risers 104*b*, or the supports 104*g*.

Figure 5:
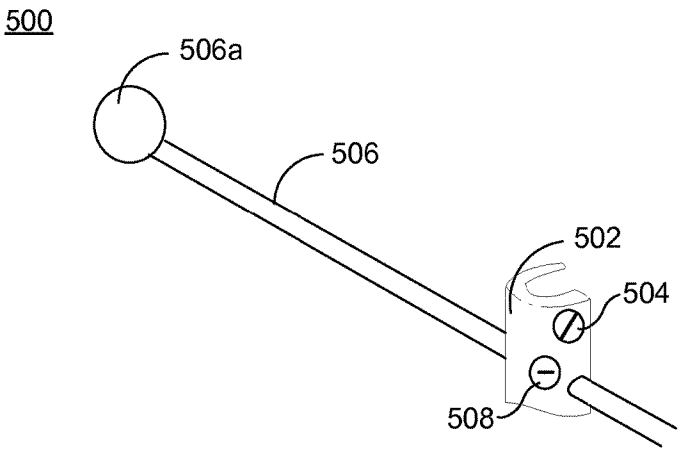
FIG. 5 is a perspective view of a sight for a projectile launching system according to an exemplary embodiment.

Additionally, FIG. 5 is a perspective view of a sight 500 for a projectile launching system according to an exemplary embodiment. The sight 500 comprises a bracket 502 that attaches to the launching system 100. For example, the bracket can fit around one of the front risers 104*a*, the rear risers 104*b*, or the supports 104*g* and can be tightened in place via the set or thumb screw 504. A flexible extension 506 extends from and is attached to the bracket 502. As illustrated, the flexible extension 506 is inserted into a hole in the bracket 502 and is secured in place via a set or thumb screw 508. In this manner, a length of the flexible extension 506 that extends from the bracket 502 can be increased or decreased to sight the system 100 for a particular shooter, distance, and/or condition. For further accuracy of the sight 500, an alignment member 508, such as a round, square, pointed, or other suitably shaped reference, can be included on the flexible extension 506 to help the shooter see the end of the flexible member. Additional alignment members 508 can be used along the length of the flexible extension 506 to use for varying distances to the target and/or wind conditions or other factors that affect accuracy. In operation, the flexible extension 506 extends into the flight path Z of the arrow 110. However, as the arrow 110 hits the flexible extension 506, the arrow 110 moves the flexible extension 506 to prevent interference with the flight of the arrow 110. The components of the sight 500 can be formed from any suitable materials, such as metal, plastic, rubber, or other suitable material.

The system 100 and its components can be formed from any suitable material or combinations of material, such as, but not limited to, steel, fiberglass, carbon fiber, titanium, plastic, aluminum, or any other suitable material or combination of materials.

Referring back to FIG. 1, the exemplary embodiment of the system 100 includes an arrow holder 112 disposed on the system 100 in a position such that an arrow 110 can be grabbed directly with the launch pad 108 from the arrow holder 112 to be ready for launch. The arrow holder 112 can hold the arrows in place via a friction fit between the arrows 110 and the arrow holder 112. The arrow holder 112 can be removably coupled to the system 100, for example, via a hook and loop type fastener or other suitable method.

The system 100 also can comprise brackets (not illustrated) to which a shoulder strap (not illustrated) can be attached for carrying the system 100.

Although specific embodiments of the present invention have been described in this application in detail, the description is merely for purposes of illustration. It should be appreciated, therefore, that many aspects of the invention were described above by way of example only and are not intended as required or essential elements of the invention unless explicitly stated otherwise. Various modifications of, and equivalent components corresponding to, the disclosed aspects of the exemplary embodiments, in addition to those described herein, can be made by those having ordinary skill in the art without departing from the spirit and scope of the present invention described herein and defined in the following claims, the scope of which is to be accorded the broadest interpretation so as to encompass such modifications and equivalent structures.

I claim:

1. A projectile launching system, comprising:

a first pair of supports;

a launching cord comprising two ends and a middle portion disposed between the two ends, each of the two ends being anchored to the system, the launching cord being supported by the first pair of supports such that the middle portion of the launching cord is disposed between the first pair of supports, extension of the middle portion of the launching cord occurring in a plane; and a projectile comprising a shaft and having a longitudinal axis along the shaft, the projectile being disposed in the launching cord in a launching position prior to launch such that the longitudinal axis of the projectile is perpendicular to the plane in which the extended middle portion of the launching cord is disposed.

2. The system of claim 1, wherein the launching cord propels the projectile past the first pair of supports, and wherein the projectile rotates to a position that is parallel with the plane in which the extended middle portion of the launching cord was disposed prior to propelling the projectile.

3. The system of claim 1, wherein the projectile comprises a center of gravity along the longitudinal axis of the projectile, and wherein the center of gravity of the projectile is located in the plane in which the extended middle portion of the launching cord is disposed.

4. The system of claim 1, wherein the launching cord comprises a first launching cord comprising first and second ends, a second launching cord comprising first and second ends, and a launching pad, the first ends of the first and second launching cords each being anchored to the system, and the second ends of the first and second launching cords each being coupled to the launching pad in the middle portion of the launching cord, and wherein the projectile is disposed in the launching cord prior to launch by being disposed adjacent to the launching pad.

5. The system of claim 4, wherein the projectile comprises a center of gravity along the longitudinal axis of the projectile, and wherein the center of gravity of the projectile is located adjacent to the launching pad prior to launch.

6. The system of claim 5, wherein the launching pad comprises an aperture therein, and wherein the center of gravity of the projectile is located adjacent to the launching pad prior to launch by being located adjacent to the aperture of the launching pad.

7. The system of claim 1, further comprising a handle coupled to the system.

8. The system of claim 7, wherein the handle comprises a longitudinal axis, and wherein the longitudinal axis of the handle is parallel to the plane in which the extended middle portion of the launching cord is disposed.

9. The system of claim 7, wherein the handle comprises a longitudinal axis, and wherein the longitudinal axis of the handle is offset from perpendicular with respect to the plane in which the extended middle portion of the launching cord is disposed.

10. The system of claim 7, further comprising an arm support to which the handle is connected, wherein a longitudinal axis of the arm support is offset from being perpendicular to a line extending between the first pair of supports.

11. The system of claim 1, further comprising a second pair of supports coupled to the system, wherein the launching cord is anchored to the system by having each of its two ends anchored to a respective one of the second pair of supports.

12. The system of claim 11, wherein a spacing between the second pair of supports is smaller than a spacing between the first pair of supports.

13. The system of claim 1, further comprising a handle coupled to the first pair of supports.

14. The system of claim 1, wherein each of the first pair of supports comprises a pulley, and wherein the launching cord is supported by the first pair of supports by being supported by the pulley on each of the first pair of supports.

15. The system of claim 1, further comprising a sight coupled to the system and extending between the first pair of supports when viewed from a firing position of the system.

16. A projectile launching system, comprising:

a launching mechanism comprising a pair of supports and an elastic member, the elastic member comprising two ends and a middle portion disposed between the two ends, each of the two ends being anchored to the system, the elastic member being supported by the pair of supports such that the middle portion of the elastic member is disposed between the pair of supports, extension of the middle portion of the elastic member occurring in a plane;

a handle coupled to the launching mechanism; and an arm support to which the handle is connected, wherein a longitudinal axis of the arm support is offset from perpendicular to a line extending between the pair of supports; and further comprising a projectile having a shaft and a longitudinal axis along the shaft, the projectile disposed in the elastic member in a launching position prior to launch such that the longitudinal axis of the projectile is perpendicular to the plane in which the extended middle portion of the elastic member is disposed, wherein the elastic member launches the projectile from the system.

17. The system of claim 16, wherein a longitudinal axis of the handle is offset from perpendicular with respect to the plane in which the extended middle portion of the elastic member is disposed by being parallel to the plane in which the extended middle portion of the elastic member is disposed.

18. The system of claim 16, further comprising a projectile comprising a center of gravity along a longitudinal axis of the projectile, the projectile disposed in the elastic member prior to launch such that the center of gravity of the projectile is located in the plane in which the extended middle portion of the launching cord is disposed.

19. The system of claim 16, wherein each of the two ends of the elastic member are anchored to the system by being anchored to a respective one of the pair of supports.

20. The system of claim 16, wherein the projectile rotates to a position after launch such that the longitudinal axis of the projectile is parallel with the plane in which the elastic member was disposed prior to launch of the projectile.

* * * * *